US008126368B2

(12) United States Patent
Aoshima et al.

(10) Patent No.: US 8,126,368 B2
(45) Date of Patent: Feb. 28, 2012

(54) CHARGE DEVICE, IMAGE FORMATION ASSEMBLY USING THE SAME, AND IMAGE FORMATION APPARATUS

(75) Inventors: Taku Aoshima, Kanagawa (JP); Osamu Handa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 341 days.

(21) Appl. No.: 12/466,933

(22) Filed: May 15, 2009

(65) Prior Publication Data

US 2010/0074652 A1 Mar. 25, 2010

(30) Foreign Application Priority Data

Sep. 25, 2008 (JP) ..... P2008-246443

(51) Int. Cl.
*G03G 15/02* (2006.01)

(52) U.S. Cl. ..... 399/174

(58) Field of Classification Search ..... 399/115, 399/168, 169, 174–176, 153
See application file for complete search history.

(56) References Cited

U.S. PATENT DOCUMENTS 5,822,169 A * 10/1998 Yoshioka et al. ..... 399/174
6,640,063 B2 * 10/2003 Adachi et al. ..... 399/176

FOREIGN PATENT DOCUMENTS

| | | | |
|---|---|---|---|
| JP | 03-203754 | | 9/1991 |
| JP | 06274004 | A * | 9/1994 |
| JP | 08-278682 | | 10/1996 |
| JP | 11-338221 | | 12/1999 |
| JP | 2001-281965 | | 10/2001 |
| JP | 2004-341044 | | 12/2004 |
| JP | 2005-024701 | | 1/2005 |

OTHER PUBLICATIONS

Machine translation of JP 06274004 A.*

* cited by examiner

*Primary Examiner* — David Gray
*Assistant Examiner* — Ruth Labombard
(74) *Attorney, Agent, or Firm* — Morgan, Lewis & Bockius LLP

(57) ABSTRACT

A charge device includes a charging belt, an electrode member, a bias supplying unit and a discharge region forming member. The belt comes into contact with a charged body. The electrode member is in contact with a part of an inner peripheral surface of the charging belt. The electrode member faces the charged body across the charging belt between the electrode member and the charged body. A downstream-side portion of the charging belt is located downstream of a position where the charged body faces the electrode member, in a moving direction of the charged body. The discharge region forming member brings the downstream-side portion into contact with the electrode member to form a discharge region in which discharge occurs between the downstream-side portion and the charged body.

15 Claims, 10 Drawing Sheets

| Vpp/Vpp1 | 1. 05 | 1. 15 | 1. 25 | 1. 35 |
|---|---|---|---|---|
| Example 1 | × | × | △ | ○ |
| Comparative Example | × | × | △ | ○ |

CHARGE DEVICE, IMAGE FORMATION ASSEMBLY USING THE SAME, AND IMAGE FORMATION APPARATUS

CROSS-REFERENCE TO RELATED APPLICATIONS

This application is based on and claims priority under 35 USC 119 from Japanese Patent Application No. 2008-246443 filed on Sep. 25, 2008.

BACKGROUND

Technical Field

The invention relates to a charge device, an image formation assembly using the same, and an image formation apparatus.

SUMMARY

According to an aspect of the invention, a charge device includes an endless charging belt, an electrode member, a bias supplying unit and a discharge region forming member. The endless charging belt is configured to come into contact with a moving charged body and to circulate in a same direction as a moving direction of the charged body. The electrode member is disposed to be in contact with a part of an inner peripheral surface of the charging belt. The electrode member is disposed to face the charged body across the charging belt between the electrode member and the charged body. The bias supplying unit applies a charge bias to the electrode member. The charging belt includes a contact portion, an upstream-side portion and a downstream-side portion. The contact portion is in contact with the charged body. The upstream-side portion is adjacent to the contact portion on an upstream side thereof in the moving direction of the charged body. The downstream-side portion is located adjacent to and downstream of a position where the electrode member faces the charged member in the moving direction of the charged body. The discharge region forming member brings the contact portion of the charging belt into contact with the charged body without contact with the electrode member and causes the upstream-side portion of the charging belt not in contact with the charged body to form a discharge suppression region in which discharge is suppressed between the upstream-side portion and the charged body. The discharge region forming member brings the downstream-side portion into contact with the electrode member without contact with the charged body to form a discharge region in which discharge occurs between the downstream-side portion of the charging belt and the charged body.

BRIEF DESCRIPTION OF THE DRAWINGS

Exemplary embodiment(s) will be described below with reference to the accompanying drawings, wherein

FIGS. 9A and 9B are views showing a result of Example 1, wherein FIG. 9A is a table showing an evaluation result of image quality, and FIG. 9B is a graph showing an evaluation result of a discharge product.

DETAILED DESCRIPTION

Outline of Exemplary Embodiments

First, an outline of exemplary embodiments of the invention will be described below.

Figure 1A:
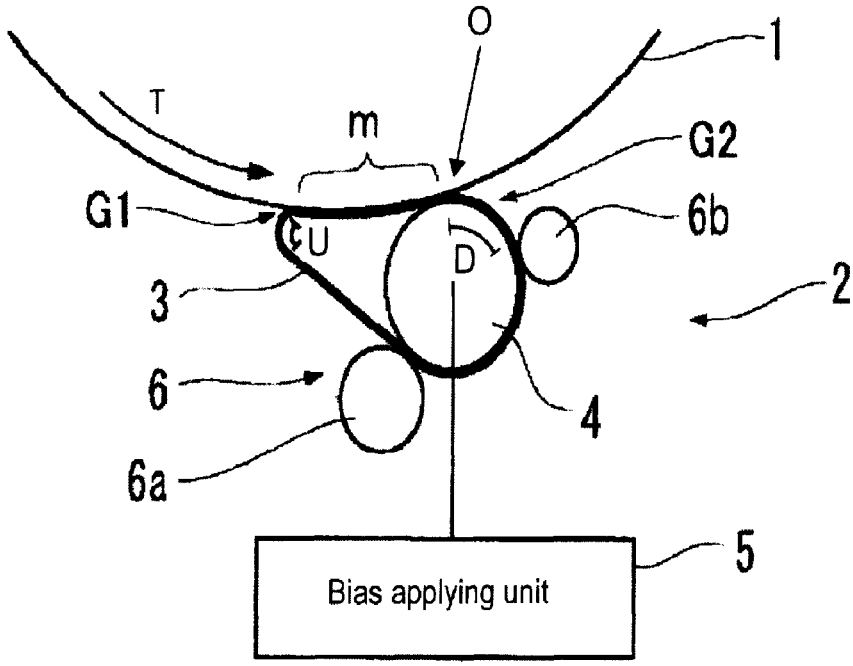
FIGS. 1A and 1B are explanatory views showing an outline of a charge device according to embodiments of the invention.

FIG. 1A shows an outline of a charge device according to an exemplary embodiment of the invention. In this figure, a charge device 2 of this exemplary embodiment includes an endless charging belt 3, an electrode member 4, a bias supplying unit 5 and a discharge region forming member 6. The endless charging belt 3 is configured to come into contact with a moving charged body 1 and to circulate in a same direction as a moving direction T of the charged body 1. The electrode member 4 is disposed to be in contact with a part of an inner peripheral surface of the charging belt 3. The electrode member 4 is disposed to face the charged body 1 across the charging belt 3 between the electrode member 4 and the charged body 1. The bias supplying unit 5 applies a charge bias to the electrode member 4. The charging belt 3 includes a contact portion m, an upstream-side portion U and a downstream-side portion D. The contact portion m is in contact with the charged body 1. The upstream-side portion U is adjacent to the contact portion m on an upstream side thereof in the moving direction T of the charged body 1. The downstream-side portion D is located adjacent to and downstream of a position O where the electrode member 4 faces the charged member 1 in the moving direction T of the charged body 1. The discharge region forming member 6 brings the contact portion m of the charging belt 3 into contact with the charged body 1 without contact with the electrode member 4 and causes the upstream-side portion U of the charging belt 3 not in contact with the charged body 1 to form a discharge suppression region G1 in which discharge is suppressed between the upstream-side portion U and the charged body 1. The discharge region forming member 6 brings the downstream-side portion D into contact with the electrode member 4 without contact with the charged body 1 to form a discharge region G2 in which discharge occurs between the downstream-side portion D of the charging belt 3 and the charged body 1.

Here, the charged body 1 may be of any type so long as it can be charged by the charge device 2. Typically, a photoreceptor for use in an image formation apparatus of the electrophotography system is exemplified. Also, the electrode member 4 may be configured to rotate to follow the charged body 1 via the charging belt 3, or may have a driving source separately. Further, the electrode member 4 may be fixedly arranged if the charging belt 3 is movable. Also, from a viewpoint of keeping a circulating shape of the charging belt 3 good, the electrode member 4 may be a rotary roller.

Also, the discharge region forming member 6 is provided to define the circulating shape of the charging belt 3 so that the downstream-side gap portion G2 serving as the discharge region is formed on the downstream side of the facing position O, where the charged body 1 faces the electrode member 4, in the moving direction T of the charged body 1 and that the contact portion m and the upstream-side gap portion G1 serving as the discharge suppression region are formed on the upstream side of the facing position O.

Therefore, the discharge region forming member 6 is provided to contact the charging belt 3, and may be provided on either of an outer peripheral surface side and an inner peripheral surface side of the charging belt 3. Also, the discharge region forming member 6 may be provided movably or not movably. For example, the discharge region forming member 6 may be fixedly arranged on the inner peripheral surface side of the charging belt 3 so as to produce a small frictional resistance. Also, the number of the discharge region forming member 6 is not particularly limited, and may be any number. From a viewpoint of simplifying the apparatus configuration, fewer discharge region forming members 6 would be better.

Here, the "discharge suppression region" denotes a region where an electric discharge based on the Paschen's law is suppressed/blocked over a width direction that intersects with the moving direction of the charging belt 3. This discharge suppression region is configured to distant from the facing position O by a length of the contact portion m of the charging belt 3, which is in contact with the charged body 1.

Also, as an example of arrangement of the discharge region forming member 6, FIG. 1A shows that the discharge region forming member 6 includes a guide member 6*a* that comes into contact with an outer peripheral surface of the charging belt 3 to guide the charging belt 3 in a predetermined direction. In this case, the guide member 6*a* may be opposite to the electrode member 4 across the charging belt 3. Alternately, an opposing member may be provided separately on the inner peripheral surface side of the charging belt 3, and then the guide member 6*a* may be arranged to be opposite to this opposing member across the charging belt 3.

Also, the number of the guide member 6*a* is not particularly limited. From a viewpoint of stabilizing a circulation speed of the charging belt 3 and simplifying the apparatus configuration, the number of the guide member 6*a* may be one. A position of the guide member 6*a* may be determined as follows. That is, the guide member 6*a* may be arranged to be opposite to the electrode member 4 across the charging belt 3.

Further, when the guide member 6*a* is employed, from a viewpoint of stabilizing discharge in the downstream-side gap portion G2, the discharge region forming member 6 may have a pressing member 6*b* as well as this guide member 6*a*. The pressing member 6*b* is provided in a position where the charging belt 3 is in contact with the electrode member 4 and on an upstream side of a position of the guide member 6*a* in the moving direction of the charging belt. The pressing member presses the charging belt 3 against the electrode member 4 so that the charging belt 3 is circulatable. The pressing member 6*b* may be provided either rotatably or fixedly so long as the charging belt 3 is circulatable. In this case, from a viewpoint of further stabilizing the discharge region, including the downstream-side gap portion G2, between the charged body 1 and the charging belt 3, the pressing member 6*b* may be provided rotatably. Here, the number of the pressing member 6*b* is not particularly limited.

Also, when the electrode member 4 is a rotary roller, from a viewpoint of more stably bringing the charging belt 3 (the contact portion m) and the charged body 1 into contact with each other, the guide member 6*a* may be rotated at a peripheral velocity that is larger than a peripheral velocity of the electrode member 4. With this configuration, the charging belt 3 is conveyed positively toward the upstream side of the position O where the charged body 1 and the electrode member 4 are opposite to each other across the charging belt 3. As a result, the charging belt 3 (the contact portion m) and the charged body 1 more stably come into contact with each other, and also, it can be avoided that the charging belt 3 is loosened and separated from the electrode member 4 in the downstream-side gap portion G2.

Figure 1B:
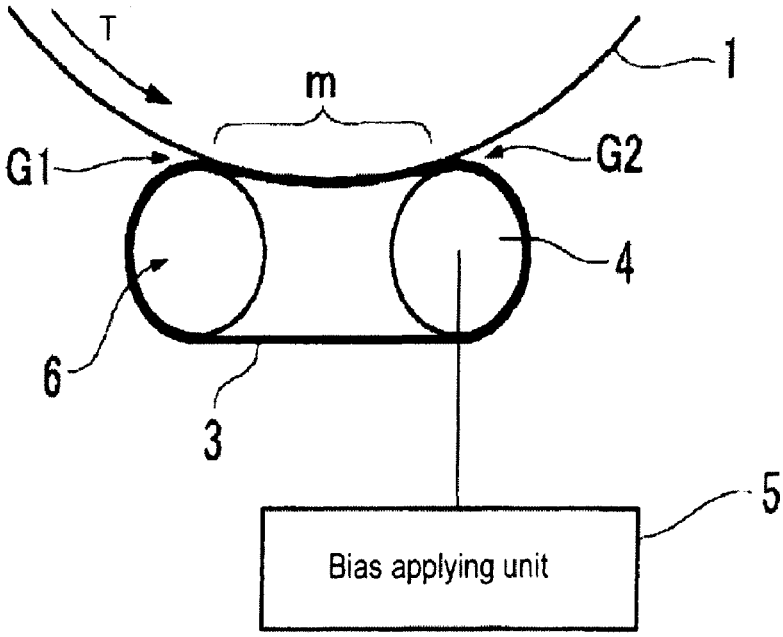

Also, as another example of arrangement of the discharge region forming member 6, FIG. 1B shows that the discharge region forming member 6 is provided on the upstream side of the electrode member 4 in the moving direction of the charged body 1 and is in contact with the inner peripheral surface of the charging belt 3 to stretch the charging belt 3. In this case, the discharge region forming member 6 may be either rotatable or not rotatable. In order to keep the circulating shape of the charging belt 3 better, the discharge region forming member 6 may be provided rotatably. Also, the discharge region forming member 6 may either be opposite to the charged body 1 across the charging belt 3 or not. From a viewpoint of stabilizing the shape of the charging belt 3 (the contact portion m), the discharge region forming member 6 may be provided to be opposite to the charged body 1 across the charging belt 3.

Also, from a viewpoint of stabilizing a charge potential of the charged body 1 produced by the bias applying unit 5, the bias applying unit 5 may apply to the electrode member 4 a charge bias in which an AC component is superimposed on a DC component. The AC component exceeds a changing point in gradients of charge potentials of the charged body with respect to AC components and is in a predetermined range.

Also, discharge in the upstream-side gap portion G1 is suppressed depending on a length of the contact portion m and a surface resistance of the charging belt 3. In the case where the surface resistance of the charging belt 3 is small, if the length of the contact portion m is long enough, the discharge in the upstream gap portion G1 can be suppressed. Also, in the case where the length of the contact portion m is short, if the surface resistance of the charging belt 3 is large enough, the discharge in the upstream gap portion G1 can be suppressed.

Also, the above charge device 2 may be applied to an image formation assembly that is detachably attached to a main body of an image formation apparatus. In this case, the image formation assembly may include either at least a part of the bias applying unit 5 of the charge device 2 or the whole bias applying unit 5. Alternatively, the image formation assembly may be configured so that a connection line extending from a bias power supply is connected thereto.

Exemplary embodiments of the invention show in the drawings will be described in more detail below.

Exemplary Embodiment 1

Figure 2:
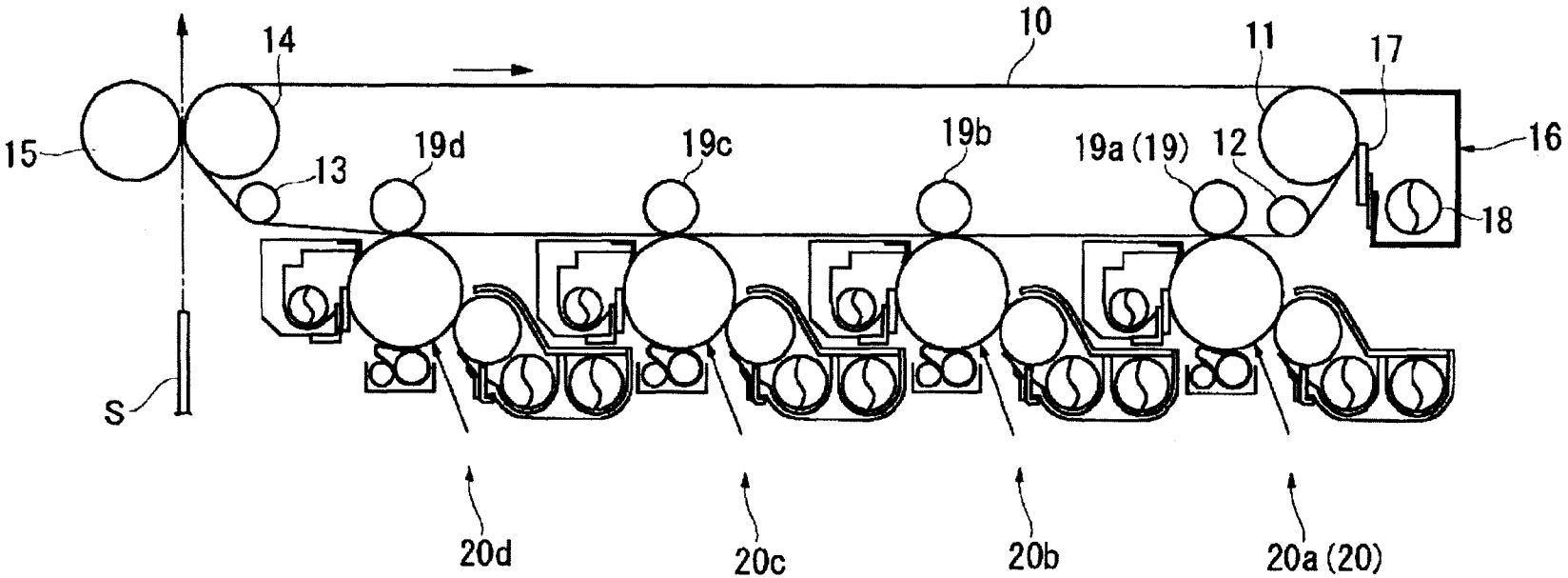
FIG. 2 is an explanatory view showing an outline of an image formation apparatus according to an exemplary embodiment 1.

FIG. 2 shows an outline of an exemplary embodiment 1 of the image formation apparatus to which the above mentioned charge device is applied. In FIG. 2, the image formation apparatus of the exemplary embodiment 1 includes an intermediate transfer belt 10 and respective color image formation assemblies 20 (20*a* to 20*d*; which may be referred to as "process cartridges" below) for four colors (e.g., yellow, magenta, cyan, black). The intermediate transfer belt 10 is stretched on plural tension rollers 11 to 14 and is circulated/rotated in a substantially lateral direction. The process cartridges 20 color image formation assemblies are arranged sequentially along one side of the intermediate transfer belt 10, which is stretched almost straightly.

The intermediate transfer belt 10 is stretched on the plural tension rollers 11 to 14, and is circulated/rotated by the tension roller 11 serving as a driving roller, for example. The intermediate transfer belt 10 temporarily carries and conveys toner images formed by the respective process cartridges 20. Around the intermediate transfer belt 10, a secondary transfer device 15 including a secondary transfer roller is provided in a position where the secondary transfer device 15 opposes to the tension roller 14 across the intermediate transfer belt 10. The tension roller 14 serves as an opposing roller to the secondary transfer device 15. A secondary transfer electric field for collectively transferring the toner images formed on the intermediate transfer belt 10 onto a recording member S that is fed from a recording member feeding portion (not shown) is applied between the secondary transfer device 15 and the tension roller 14. Also, a belt cleaning device 16 for cleaning residual toners on the intermediate transfer belt 10 is provided in a position where the belt cleaning device 16 opposes to the tension roller 11 across the intermediate transfer belt 10. The cleaning device 16 includes a blade 17 and a stirring/conveying member 18. The blade 17 is provided to be retractable with respect to the intermediate transfer belt 10 and cleans the residual toners. The stirring/conveying member 18 conveys the toners cleaned by the blade 17 to a wasted toner recovery portion (not shown).

Also, primary transfer devices 19 (19*a* to 19*d*) are provided in positions on the rear surface side of the intermediate transfer belt 10 where the primary transfer devices 19 oppose to the process cartridges 20, respectively. Each primary transfer device 19 includes a primary transfer roller that transfers toner images formed by the corresponding process cartridge 20 onto the intermediate transfer belt 10. Therefore, the toner images of the respective colors transferred by the primary transfer devices 19 are multiplexed sequentially on the intermediate transfer belt 10, and then the multiplexed toner images are transferred collectively onto the recording member S by the secondary transfer device 15. In this case, a primary transfer electric field used to transfer the respective color toner images onto the intermediate transfer belt 10 is applied between the primary transfer devices 19 and the process cartridges 20. Also, a fixing device (not shown) applies heat and pressure to the recording member S onto which the toner images are transferred collectively by the secondary transfer device 15, to thereby fix the toner images to the recording member S.

Figure 3:
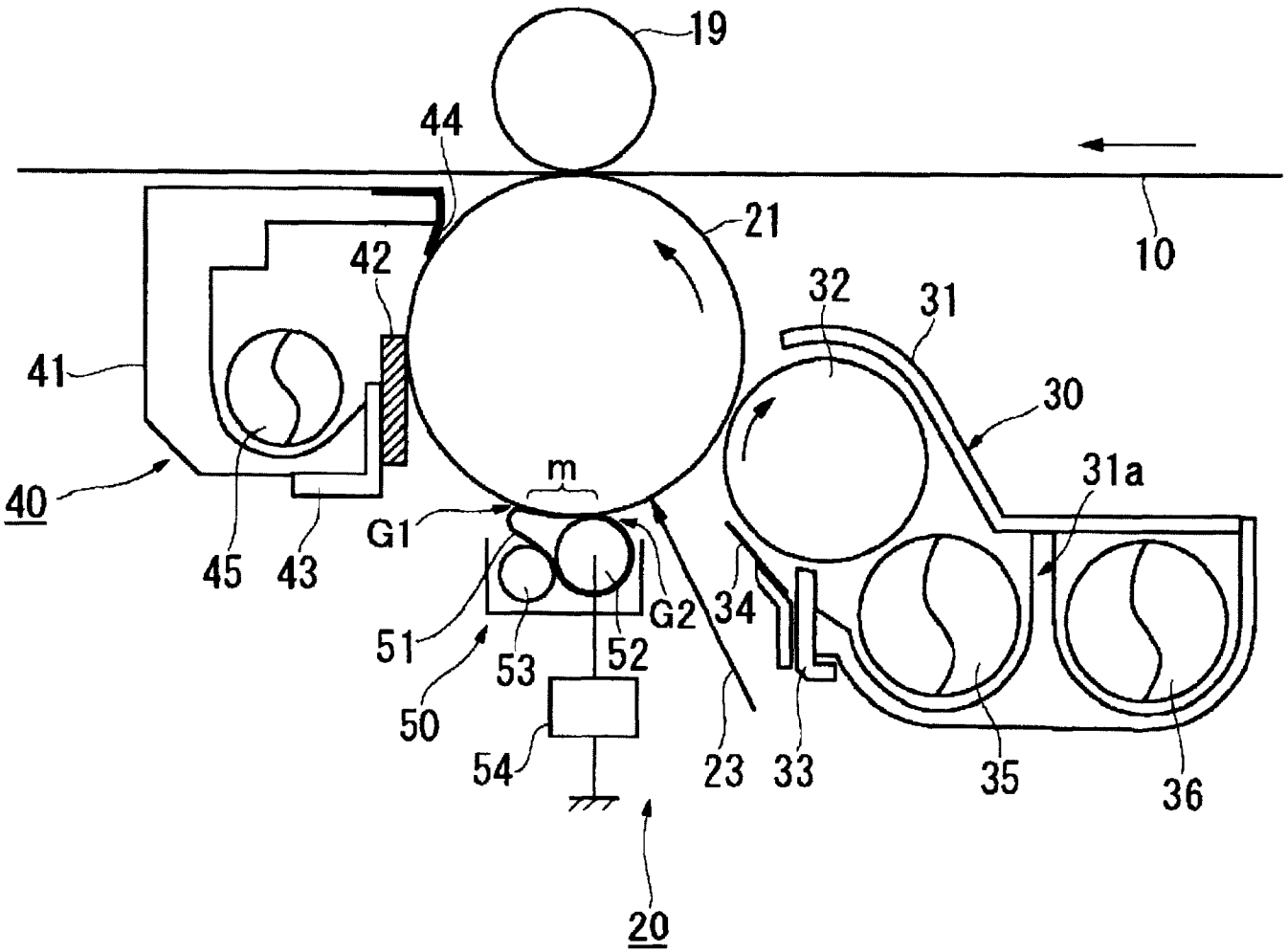
FIG. 3 is an explanatory view showing a process cartridge according to the exemplary embodiment 1.

FIG. 3 exemplarily shows one process cartridge 20. The process cartridge 20 of the exemplary embodiment 1 is configured so as to be detachable from a casing of the image formation apparatus. Since the respective process cartridges 20 (20*a* to 20*d*) have the substantially same configuration except for developer used therein (in this example, a two-component developer containing toners and carriers is employed), one process cartridge 20 will be described below.

The process cartridge 20 of the exemplary embodiment 1 includes a photoreceptor 21, a charge device 50, a developing device 30 and a cleaning device 40. The photoreceptor 21 serves as an image carrier that carries a toner image. The charge device 50 charges the photoreceptor 21. The developing device 30 visualizes with the toner a latent image formed by exposing the photoreceptor 21, which is charged by the charge device 50. The cleaning device 40 cleans a residual toner on the photoreceptor 21 after the toner image on the photoreceptor 21 is transferred onto the intermediate transfer belt 10 by the primary transfer device 19. Here, an arrow indicated by a reference numeral 23 denotes a laser beam that is emitted from a laser scanning device that is an example of an exposure device (not shown) and corresponds to one color. In the exemplary embodiment 1, one laser scanning device exposes the photoreceptor 21 of the process cartridge 20 for each color through a gap (not shown) of a housing of the process cartridge 20.

Also, the developing device 30 includes a housing 31 that has an opening in a position corresponding to the photoreceptor side. A developer roller 32 is disposed in the position where the developer roller 32 is opposed to the photoreceptors 21 with facing this opening. The developer roller 32 has a magnet in which N poles and S poles of magnetic poles are arranged appropriately, for example, and a non-magnetic developing sleeve is rotated around the magnet. A layer thickness restricting member 33 for restricting a layer thickness of the developer on the developer roller 32 is disposed around the developer roller 32 with a predetermined gap being formed between the layer thickness restricting member 33 and the developer roller 32. A sealing member 34 having one end that is fixed to the housing 31 is provided on a downstream side of the layer thickness restricting member 33 in the rotating direction of the developer roller 32. The sealing member 34 prevents the developer restricted by the layer thickness restricting member 33 from scattering from the housing 31 to the outside. Also, a supply stirring/conveying member 35 for supplying the developer to the developer roller 32 mainly is arranged on an upstream side of the layer thickness restricting member 33 in the rotating direction of the developer roller 32. The supply stirring/conveying member 35 is disposed in a lower oblique position with respect to the developer roller 32 so as to be opposed to the developer roller 32. Also, a mix stirring/conveying member 36 for applying a frictional electrification to the developer mainly is arranged in rear of the supply stirring/conveying member 35. Also, the developer is circulated between the supply stirring/conveying member 35 and the mix stirring/conveying member 36 via openings formed in a partition wall 31*a* of the housing 31.

In the developing device 30 having the above configuration, the developer stirred/conveyed by the two stirring/conveying members 35, 36 is fed onto the developer roller 32 by the supply stirring/conveying member 35. The layer thickness of the developer fed onto the developer roller 32 is restricted by the layer thickness restricting member 33, and is conveyed to a developing region that is the opposing portion of the developer roller 32 to the photoreceptor 21 in a state that a predetermined amount of developer is formed on the developer roller 32. In the developing region, the toner contained in the developer is caused to fly in response to the latent image on the photoreceptor 21 by an action of the developing electric field applied between the photoreceptor 21 and the developer roller 32. Thereby, the latent image on the photoreceptor 21 is rendered visible. Also, the developer that passes through the developing region is recovered onto the supply stirring/conveying member 35 by an action of a repulsion magnetic field produced by the magnetic pole arrangement, for example, and is conveyed to the mix stirring/conveying member 36. In the exemplary embodiment 1, the developing device using the two-component developer is illustrated as the developing device 30. However, the developer is not limited to the two-component developer. For example, it is needless to say that a developing system only using a toner may be employed.

Meanwhile, the cleaning device 40 has a housing 41, a blade 42 serving as a plate-like cleaning member, a film-like sealing member 44 and a stirring/conveying member 45. The housing 41 has an opening to oppose to the photoreceptor 21. This blade 42 is provided to correspond to an opening edge portion on the lower side of the opening and cleans the residual toner on the photoreceptor 21. The sealing member 44 is provided to correspond to an opening edge portion on the upper side of the opening and prevents the toner cleaned by the blade 42 from scattering. The stirring/conveying member 45 is provided in the housing 41 and conveys the wasted toner recovered in the housing 41 to the wasted toner recovering portion (not shown). A base end side of the blade 42 located on the opposite side to the portion of the blade contacting the photoreceptor 21 is fitted to the housing 41 via an almost L-shaped blade supporting member 43. Also, an opening-side top end surface of the blade 42, which is a free end, directs upwardly.

Next, the charge device 50 will be described below. The charge device 50 of the exemplary embodiment 1 includes an endless charging belt 51, a bias applying roller 52 serving as an electrode member, a guide roller 53 serving as a discharge region forming member, and a bias power supply 54. The charging belt 51 has a contact portion m that comes into contact with the photoreceptor 21, and is circulated in the same direction as the moving direction of the photoreceptor 21 in the contact portion m. The bias applying roller 52 is provided on the inner peripheral surface of the charging belt 51, and is disposed to opposite to the photoreceptor 21 across the charging belt 51. The guide roller 53 is provided so as to form between the charging belt 51 and the photoreceptor 21 (i) a discharge region (a downstream-side gap portion G2) that is adjacent to a facing position where the photoreceptor 21 faces the bias applying roller 52 and on the upstream side of the facing position in the moving direction of the photoreceptor 21, (ii) a contact region, on the upstream side of the opposition position, in which the contact portion m of the charging belt 51 comes into contact with the photoreceptor 21 and (iii) a discharge suppression region (an upstream-side gap portion G1) that is adjacent to the contact region. The bias power supply 54 applies a charge bias between the bias applying roller 52 and the photoreceptor 21.

Also, the guide roller 53 of the exemplary embodiment 1 comes into contact with the outer peripheral surface of the charging belt 51, and guides the charging belt 51 in a predetermined direction so as to bring a part of the charging belt 51 that does not contact the bias applying roller 52 into contact with the photoreceptor 21. In this exemplary embodiment, the guide roller 53 is provided so that the guide roller 53 is opposite to the bias applying roller 52 across the charging belt 51 in a downstream end position of a portion of the charging belt 51 that is in contact with the bias applying roller 52 in the circulating direction of the charging belt 51. The guide roller 53 is rotated at a peripheral velocity that is about 10% larger than a peripheral velocity of the bias applying roller 52. A peripheral velocity difference is realized by changing a ratio between gears that are provided in rotating shafts of the bias applying roller 52 and the guide roller 53, respectively. In this exemplary embodiment, the bias power supply 54 itself may be provided in the process cartridge 20. From a viewpoint of reducing a size and a weight of the process cartridge 20 as well as utilizing the bias power supply 54 effectively, the process cartridge 20 may be provided with a connecting mechanism to which the bias power supply 54 is connectable.

As the charging belt 51 of the exemplary embodiment 1, a film-like member whose surface resistance is adjusted to $10^6$ to $10^8\Omega/\square$ by dispersing an conducting material such as carbon black into PVdf and whose thickness is about 45 μm, for example, is employed. However, the charging belt 51 is not limited thereto. Any member may be employed as the charging belt 51 so long as it can apply a stable charging electric field independent of a usage environment. For example, a member that is obtained by dispersing the conducting material is dispersed into polyamide, polyimide, polyetherimide, elastomer PVdF, polyester, polycarbonate, polyolefin, PEN, PEEK, PES, PFA, ETFE, CTFE, or the like and forming it into a film shape may be employed. Also, the charging belt 51 has a rigidity to such an extent that the stable contact portion m can be ensured while the belt is being circulated.

Also, as the bias applying roller 52, a roller formed by coating a coating member made of conductive foamed polyester around a core metal is employed. However, any material may be employed so long as it has conductivity and adequate elasticity.

Furthermore, as the guide roller 53, a roller formed by coating polyurethane foam around a core metal is employed. However, from the viewpoint of conveying the charging belt 51 stably between the guide roller 53 and the bias applying roller 52, a roller-like porous elastic body (sponge) formed to have a predetermined cell density may be employed as the guide roller 53. For example, ether-based urethane foam, polyethylene foam, polyolefin foam, melamine foam, or the like may be employed.

Also, in the exemplary embodiment 1, in order to further improve a stability of the electric discharge while stabilizing the shape of the charging belt 51 in the downstream-side gap portion G2 located adjacent to the downstream side of the contact portion m of the charging belt 51, which is in contact with the photoreceptor 21, provided is a pressing mechanism for pressing the bias applying roller 52 against the photoreceptor 21 side so as to suppress fluctuation in a gap between the photoreceptor 21 and the charging belt 51. An example of the pressing mechanism is as follows. A conductive resin bearing is attached to the rotating shaft of the bias applying roller 52, and the conductive bearing is urged by an urging spring to thereby press the bias applying roller 52 against the photoreceptor 21. The urging spring, for example, is set to urge one end portion of the rotating shaft of the bias applying roller 52 by about 2.4 to 3.43 N (about 250 to 350 gf), for example, which does not contain the load of the bias applying roller 52.

Figure 4:
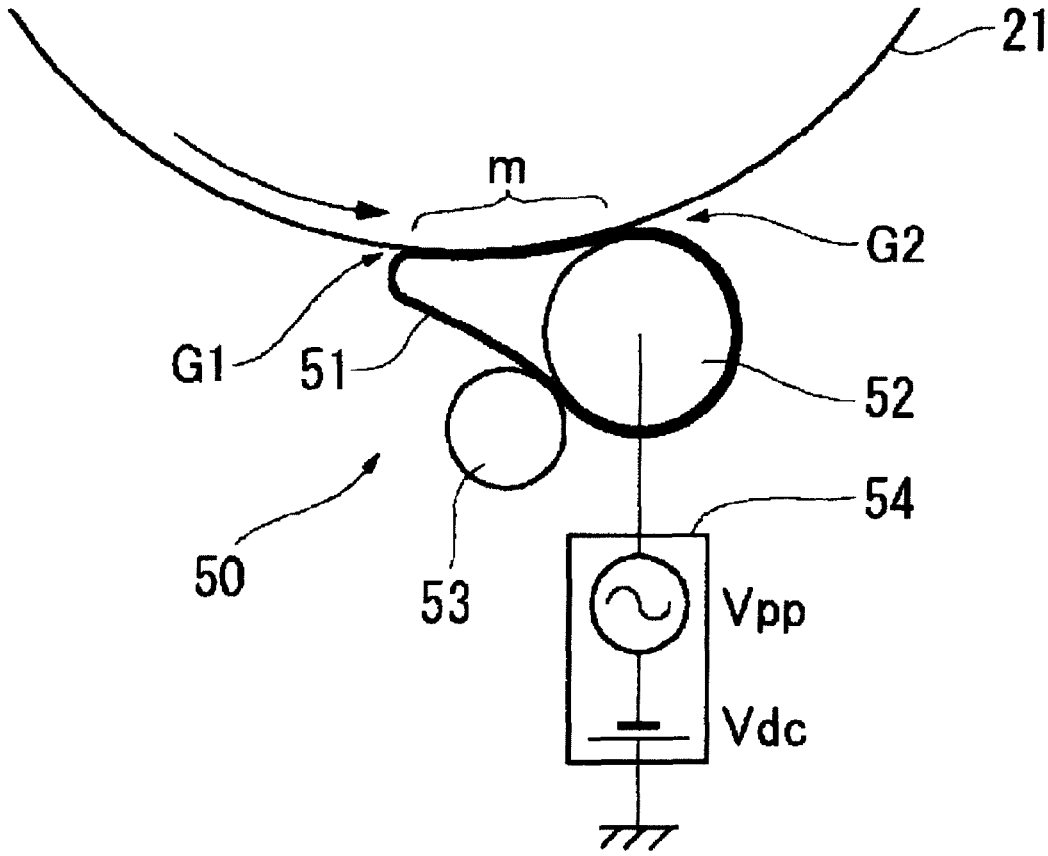
FIG. 4 is an explanatory view showing an outline of the charge device according to the exemplary embodiment 1.

Next, a charging action in the charge device 50 of the image formation apparatus will be described in detail with reference to FIG. 4 below. Here, the bias power supply 54 of the exemplary embodiment 1 is configured to apply the charge bias in which an AC component Vpp is superposed on a DC component Vdc.

In the exemplary embodiment 1, the charging belt 51 is conveyed by a conveyance force produced between the bias applying roller 52 and the guide roller 53. In particular, since the peripheral velocity of the guide roller 53 is set larger than the peripheral velocity of the bias applying roller 52, the contact region between the charging belt 51 and the photoreceptor 21 can be formed stably (the charging belt 51 (the contact portion m) is stably in contact with the photoreceptor 21). Furthermore, with this configuration, the charging belt 51 is not loosened and separated from the bias applying roller 52 on the downstream side of the contact portion of the charging belt 51. Therefore, the stable contact state can be kept in the contact region between the charging belt 51 and the photoreceptor 21 (the contact portion m of the charging belt 51 is stably in contact with the photoreceptor 21).

Between the photoreceptor 21 and the charging belt 51, which have having the contact region (in which the contact portion m of the charging belt 51 is in contact with the photoreceptor), the electric discharge easily occurs in the gap portions before and after the contact region (specifically, the upstream-side gap portion G1 and the downstream-side gap portion G2), and it is hard that the electric discharge occurs in the contact region. Also, in the exemplary embodiment 1, since the gap portion G1 is distant from the bias applying roller 52, the electric discharge in the upstream-side gap portion G1 is suppressed and seldom occurs. In contrast, the electric discharge occurs in the downstream-side gap portion G2. As a result, in the exemplary embodiment 1, the electric discharge occurs only in the downstream-side gap portion G2 located adjacent to the downstream side of the contact portion m of the charging belt 51. In order to suppress the electric discharge in the upstream-side gap portion G1, the contact region (contact portion m of the charging belt 51) is determined to have a length so that the electric discharge based on the Paschen's law does not occur in the upstream-side gap portion G1. The length of the contact region is enough if it is larger than a radius of the bias applying roller 52, for example.

Then, an action between the photoreceptor 21 and the charging belt 51 in the charging operation will be guessed below. That is, since the minute gap is narrowed gradually in the upstream-side gap portion G1 along the moving direction of the photoreceptor 21, an average charge potential on the surface of the photoreceptor 21 is increased and thus the charge potential is produced in accordance with a frequency of the charge bias. Since no electric discharge occurs in the contact region in which the contact portion m of the charging belt 51 is in contact with the photoreceptor 21, amplitude of the potential is maintained. In contrast, since the minute gap is expanded gradually in the downstream-side gap portion G2 along the moving direction of the photoreceptor 21, a large amplitude of the potential existing near the terminal end of the contact region is averaged as the minute gap expands. Thus, a uniform charge is achieved near the terminal end of the downstream-side gap portion G2.

Figure 5:
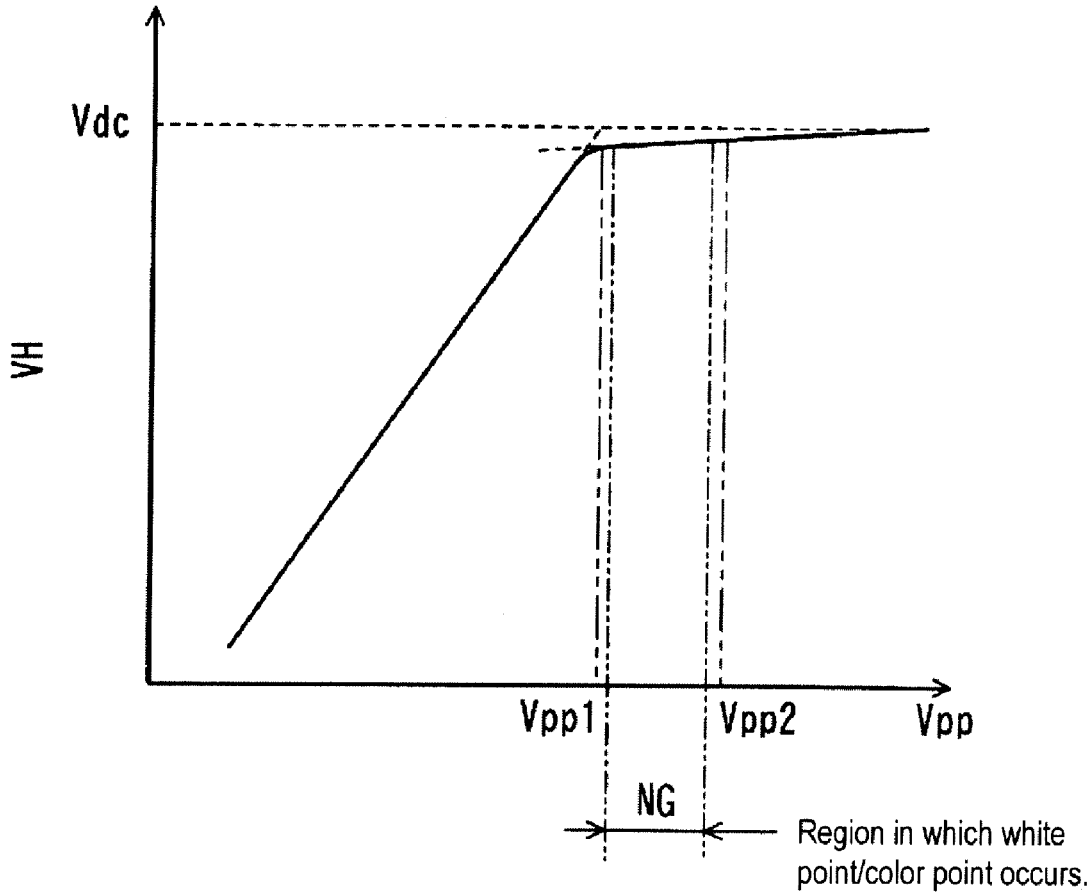
FIG. 5 is a graph showing a relationship between an AC component of a charge bias and a charge potential.

Also, in the case where the photoreceptor 21 and the charging belt 51 have this positional relation, a relationship shown in FIG. 5 can be found by focusing attention on a relationship between the charge bias (Vpp+Vdc) applied from the bias power supply 54 and the charge potential VH of the photoreceptor 21 (corresponding to the surface potential). That is, the charge potential VH increases gradually along with an increase of the AC component Vpp of the charge bias, then the charge potential VH is saturated substantially after a changing point (corresponding to Vpp1), and then a subsequent increase in charge potential VH is very small.

Now, assuming that only the DC component Vdc is applied as the charge bias, the charge potential VH increases linearly as the DC component Vdc increases. However, if it is tried to control the charge potential VH only by using the DC component Vdc, a change of physical property of the charging belt 51 or the bias applying roller 52 due to environmental changes, for example, makes it difficult to maintain the stable charge potential VH. For example, it is required to adjust the applying charge bias in accordance with the environmental conditions. Therefore, the actual application becomes difficult. As a consequence, the AC component Vpp is superposed on the DC component Vdc.

When the AC component Vpp is to be superposed on the DC component Vdc, if the AC component Vpp is small, the discharge region is expanded gradually together with an increase of the AC component Vpp and also the charge potential VH is increased linearly. If the AC component Vpp becomes large to some extent, the charge potential VH comes close to a value of the DC component Vdc. Then, after the the AC component Vpp has become larger than a changing point Vpp1, even if the AC component Vpp is increased further, the charge potential VH is not increased to exceed the DC component Vdc. Therefore, in order to stabilize the charge potential VH, the AC component Vpp that is larger that the changing point Vpp1 may be applied.

Meanwhile, in order to charge uniformly in the downstream-side gap portion G2, it is necessary to expand the discharge region in the downstream-side gap portion G2. The reason is as follows. In the range between Vpp1 and Vpp2 in FIG. 5 (an NG region in FIG. 5), the electric discharge is easily influenced by fluctuation of a gap and non-uniformity of a resistance value in the downstream-side gap portion G2, and the electric discharge is in an unstable state. Therefore, non-uniform charging or failure charging easily occurs, and there is a concern that a white point or a color point occurs due to the non-uniform charging and the failure charging. As a result, in order to achieve the stable charge potential VH, the AC component Vpp whose magnitude (Vpp2 or more in FIG. 5) exceeds such unstable area (the NG area) is applied. With this configuration, the discharge region is expanded in the terminal end direction of the downstream-side gap portion G2, and the charge potential VH is hardly influenced by the fluctuation of a gap and the non-uniformity of a resistance.

Also, in the exemplary embodiment 1, the discharge to the photoreceptor 21 is suppressed in the upstream-side gap portion G1. Therefore, producing of a discharge product does not cause any problem in the upstream-side gap portion G1, and the discharge product is produced in the downstream-side gap portion G2. Therefore, an amount of the discharge product can be suppressed to about half of that in the configuration in which the charging belt 51 is merely wound on the bias applying roller 52. As a result, the defect of image quality (e.g., omission of an image, or the like) due to the discharge product can be reduced and wear of the photoreceptor 21 can be suppressed. Also, the cleaning on the photoreceptor 2 can be done well. Also, depending on the configuration of the cleaning device 40, the damage on the contact portion thereof may be reduced.

In the exemplary embodiment 1, the peripheral velocity of the guide roller 53 is set larger than the peripheral velocity of the bias applying roller 52. However, the peripheral velocity of the guide roller 53 may be set equal to the peripheral velocity of the guide roller 53 of the bias applying roller 52, so long as respective shapes of the photoreceptor 21 and the charging belt 51 are stable in the downstream-side gap portion G2.

Figure 6:
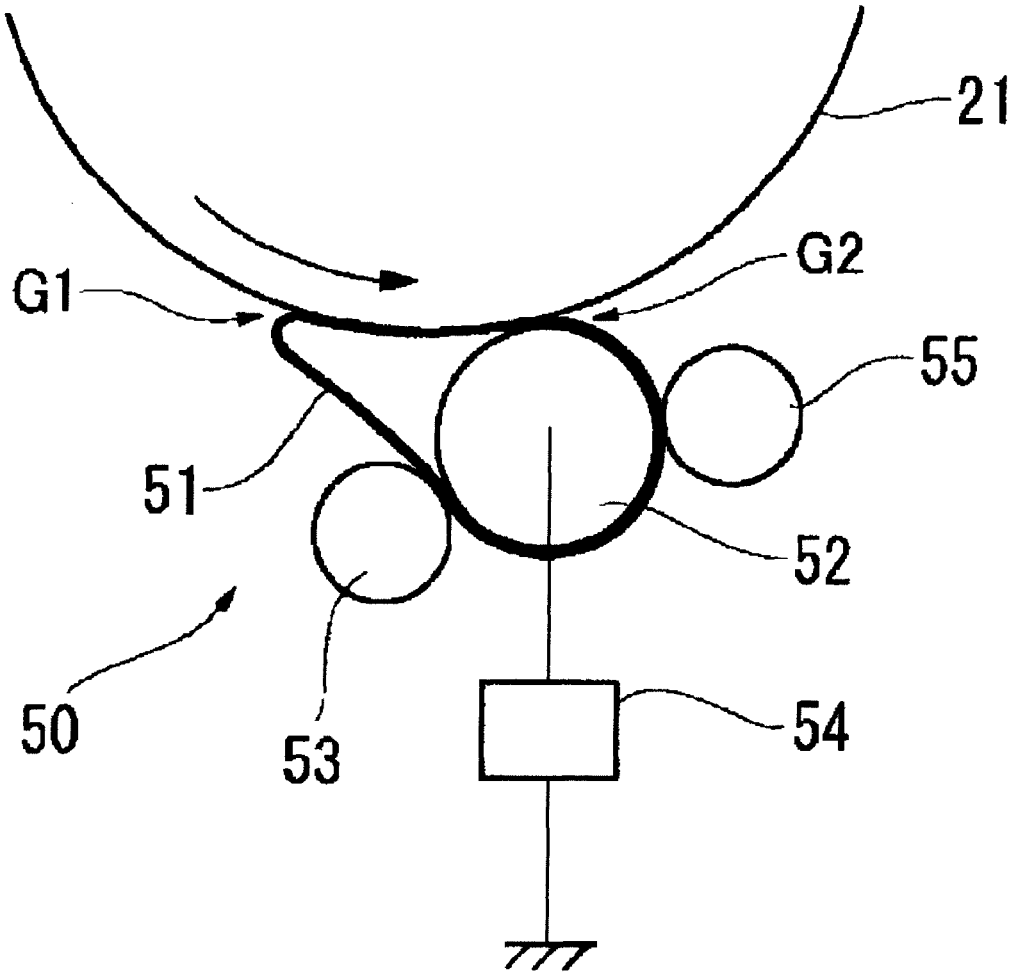
FIG. 6 is an explanatory view showing a modification example of the charge device according to the exemplary embodiment 1.

Further, FIG. 6 shows the charge device 50 according to a modification example of the exemplary embodiment 1. The charge device 50 includes a press roller 55 arranged to be opposite to the bias applying roller 52 across the charging belt 51, in addition to the charging belt 51, the bias applying roller 52, the guide roller 53, and the bias power supply 54. The press roller 55 presses the charging belt 51 to be movable with respect to the bias applying roller 52. The press roller 55 can stabilize the shape of the downstream-side gap portion G2 much more by suppressing deviation of the charging belt 51 from the bias applying roller 52. Therefore, the press roller 55 is provided on the downstream side of the downstream-side gap portion G2 in the rotating direction of the bias applying roller 52 so that the charging belt 51 is sandwiched between the bias applying roller 52 and the press roller 55. A peripheral velocity of the press roller 55 may be set to be larger than a peripheral velocity of the bias applying roller 52. However, the press roller 55 and the bias applying roller 52 may have the same peripheral velocity or the press roller 55 may be rotated simply following the bias applying roller 52 so long as the charging belt 51 is not loosened from the bias applying roller 52. In this modification example, the press roller 55 formed of the roller is exemplified. However, the press roller 55 is not limited thereto. A plate-like member made of a material having a small friction coefficient with respect to the charging belt 51 may be provided on the outer periphery of the bias applying roller 52 as a press member, so as to prevent the charging belt 51 from deviating from the bias applying roller 52.

Exemplary Embodiment 2

Figure 7:
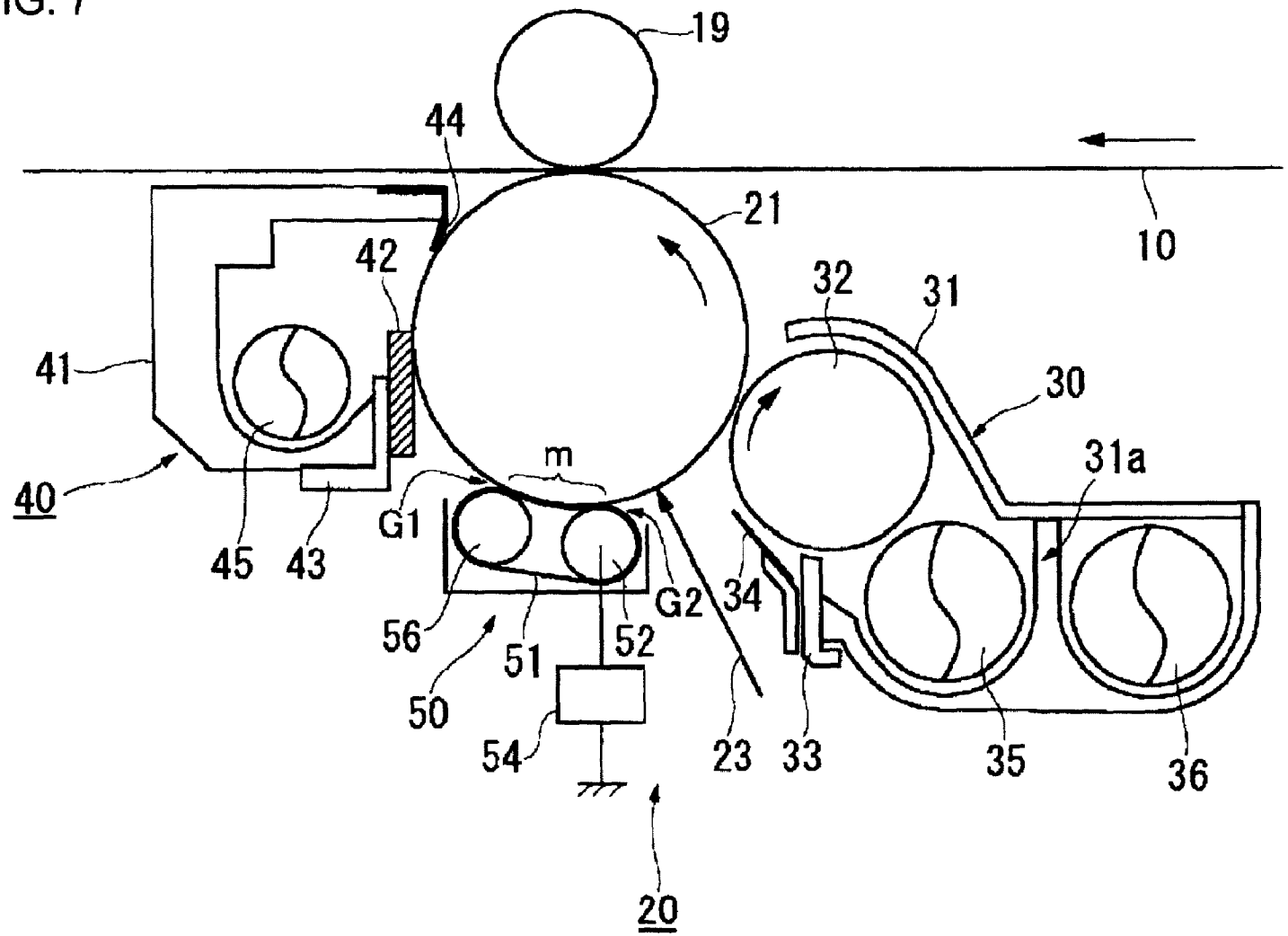
FIG. 7 is an explanatory view showing a process cartridge according to an exemplary embodiment 2.

FIG. 7 shows a process cartridge 20 for use in an image formation apparatus according to exemplary embodiment 2. The process cartridge 20 of the exemplary embodiment 2 is configured substantially similarly to the process cartridge 20 of the exemplary embodiment 1 (see FIG. 3), but is different in the configuration of the charge device 50 from the exemplary embodiment 1. Here, the similar reference symbols are assigned to the constituent elements similar to those of the exemplary embodiment 1, and detailed description thereon will be omitted.

In the charge device 50 of the exemplary embodiment 2, the discharge region forming member includes a tension roller 56. The tension roller 56 is provided to be in contact with the inner peripheral surface of the charging belt 51 on the upstream side of the bias applying roller 52 in the moving direction of the photoreceptor 21, and the charging belt 51 is stretched between the tension roller 56 and the bias applying roller 52. Also, in the exemplary embodiment 2, the tension roller 56 is arranged to be opposite to the photoreceptor 21 across the charging belt 51, and a contact region (in which the contact portion m of the charging belt 51 is in contact with the photoreceptor 21) is defined between the facing positions where the tension roller 56 and the bias applying roller 52 face the photoreceptor 21 across the charging belt 51, respectively. That is, the charging belt 51 is circulated in a state that such charging belt 51 is stretched between two tension rollers (the bias applying roller 52 and the tension roller 56).

In this exemplary embodiment 2, the downstream-side gap portion G2 included in the discharge region is stabilized, while the electric discharge in the upstream-side gap portion G1 is hard to occur. Therefore, not only the defect of image quality (e.g., omission of image, or the like) due to the discharge product can be reduced but also the cleaning on the photoreceptor 21 is carried out well.

Figure 8A:
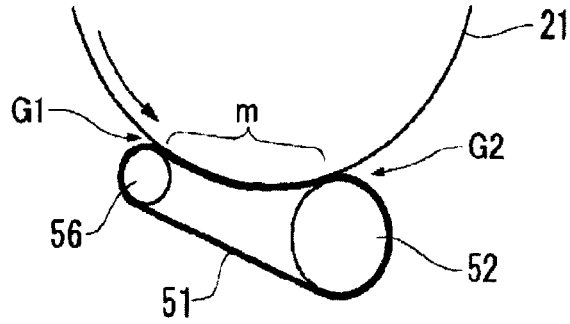
FIGS. 8A to 8C are explanatory views showing modification examples of the charge device according to the exemplary embodiment 2.
Figure 8B:
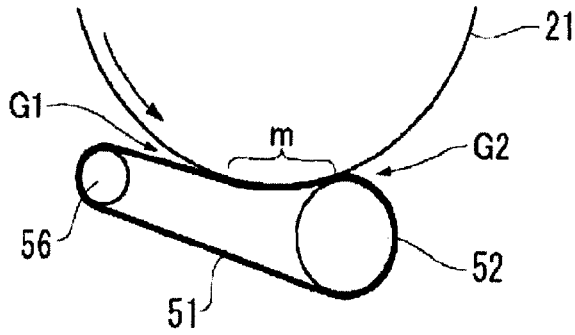
Figure 8C:
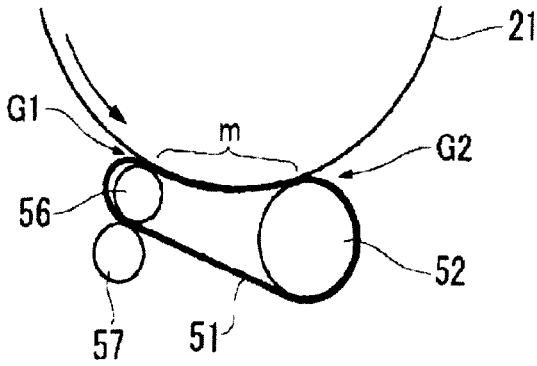

The charge device 50 using this tension roller 56 is not limited to that shown in FIG. 7. For example, any of configurations shown in FIGS. 8A to 8C may be employed, for example. In FIG. 8A, a size of the tension roller 56 is set smaller than that of the bias applying roller 52. The sufficient contact region can be formed in this modification example, and the downstream-side gap portion G2 included in the discharge region can be stabilized. Also, in FIG. 8B, the tension roller 56 is provided out of the position where the tension roller 56 is opposite to the photoreceptor 21. Also, the contact region can be ensured sufficiently in this modification example, and the downstream-side gap portion G2 included in the discharge region can be stabilized. In this case, when the tension roller 56 is urged to be apart from the bias applying roller 52, the circulating shape of the charging belt 51 can be formed more stably. Also, in FIG. 8C, another guide roller 57 like the exemplary embodiment 1 is provided for the tension roller 56 of FIG. 8A. According to this modification example, the circulating shape of the charging belt 51 can be formed stably, and also the downstream-side gap portion G2 included in the discharge region can be stabilized.

Here, the tension roller 56 having the roller configuration is exemplified as the discharge region forming member. However, the tension roller 56 is not limited thereto. For example, a material having a small frictional resistance with respect to the charging belt 51 may be employed and may be arranged fixedly.

In the above exemplary embodiments 1 and 2, the image formation apparatus having the configuration that four-color process cartridges 20 are arranged to be opposite to the intermediate transfer belt 10 is illustrated. However, plural developing devices may be arranged around the photoreceptor 21 in place of the process cartridges, or a rotary-type developing device may be arranged around the photoreceptor 21. Also, the toners are not limited to four colors, and a monochrome toner may be employed. Further, the system for directly transferring the toner image from the photoreceptor 21 to the recording material may be employed without the intermediate transfer belt 10.

Also, the photoreceptor 21 is not limited to the drum type, but may be the belt-type photoreceptor. The photoreceptor 21 may be of the belt type so long as the contact region in which the contact portion m of the charging belt 51 comes into contact with the photoreceptor 21 and the downstream-side gap portion G2 are formed stably.

EXAMPLES

Example 1

In Example 1, in order to check the effectiveness of the charge device of the above exemplary embodiments, weight up are the image quality and discharge product of the exemplary embodiment 1 and charge device configured by winding the charging belt over the whole circumference of the bias applying roller.

As to the evaluation of the image quality, an occurring situation of the white dot/color dot when the AC component Vpp of the charge bias is changed is checked in the configuration of the exemplary embodiment 1. Also, as to the discharge product, in order to check the influence of the discharge product produced by the charging, it is checked is how a difference between a pure-water contact angle of the photoreceptor before the discharge start and a pure-water contact angle after the photoreceptor is rotated 30 turns is changed when the ratio Vpp/Vpp1 is changed in the configuration in which there is merely provided a combination of the photoreceptor and the charge device.

An organic photosensitive body is employed as the photoreceptor. An under coating layer for preventing leakage is formed on a surface of a drum base body made of an aluminum alloy. A charge generating layer having 1 μm or less in film thickness is, for example, laminated on the under coating layer. A charge transporting layer having 15 to 40 μm in film thickness, for example, is laminated thereon. Then, a surface layer having an antiwear property may be laminated on a surface of the charge transporting layer, if necessary. Here, an a-SiN:H film, an a-C:H film containing no Si, an a-C:H:F film, or the like, for example, may be used as the surface layer. Such a surface layer can have such a antiwear property that a wear amount per 1000 turns is less than 20 nm.

Also, a toner used in Example 1 is prepared by the emulsion polymerization method. The toner has 5.8 μm in volume average particle diameter when measured by the Coulter counter (manufactured by BECKMAN COULTER, Inc). The particle diameter of the toner is not limited thereto, and the toner having 3 to 7 μm in volume average particle diameter may be used. Also, the shape of the toner is represented by a shape factor SF-1. an enlarged photograph of the toner obtained by the optical microscope (Micro Photo FXA manufactured by Nikon Corporation) is image-analyzed by Image Analyzer Luzex 3 (manufactured by NIRECO Co., Ltd.), and then plural toner particles are calculated and averaged by the following expression. Thus, the toners having 130 to 140 in shape factor SF-1 are employed.

$$\text{Shape factor SF-1}=(\text{absolute maximum length of toner diameter})^2/(\text{projected area of toner})\times(100\pi/4)$$

Also, as an external additive, inorganic fine particles such as silica, titania, or the like, having 10 to 150 nm in average particle diameter are added appropriately to the toner. Then, a two-component developer is prepared by mixing the toner with a carrier made of ferrite beads having 35 μm in average particle diameter. In this case, the toner is not limited to the polymerization toner, but may be the grounded toner.

Also, the charge device of Example 1 is configured as follows.

As the charging belt, used is a belt whose surface resistance is adjusted to $10^6\Omega/\square$ by dispersing a conducting material into PVdf (a pure-water contact angle θ is about 90 degrees) and whose thickness is set to 45 μm.

The bias applying roller is configured by coating conductive foam polyester onto a core metal made of a metal to have an outer diameter of 12 mm. At this time, an urging spring is provided in one end of a rotating shaft of a bias applying roller so that the bias applying roller is pressed against the photoreceptor side by 275 gf.

As a guide roller, one configured by coating polyurethane foam onto a free-cutting stainless steal having 6 mm in outer diameter as a core metal so as to have 10 mm in outer diameter is employed. At this time, a thickness of polyurethane foam is 2 mm, and the guide roller is set to bite into the bias applying roller via the charging belt by 0.5 mm. Also, a hardness of the polyurethane foam is set so that the load of about 80 to 150 gf to press a circular plate sample of ϕ50 mm into this foam by 0.5 mm. Then, a peripheral velocity of the guide roller is set to be 10% larger than a peripheral velocity of the bias applying roller.

In the evaluation of the image quality, a process speed of the apparatus is set to 208 mm/sec, a charge potential (corresponding to a surface potential) of the surface of the photoreceptor is set to −710 V, a potential of an exposed image portion is set to −300 V, and a developing bias in which the AC component of a rectangular wave having 1.0 kV in amplitude (peak-to-peak voltage), 6 kHz in frequency and 60% in duty factor is superposed on the DC component of −560 V is employed.

Also, in the evaluation, it is checked by changing the AC component of the charge bias while forming 30% halftone image how the defect of image quality such as a white point and a color point is changed with respect to Vpp/Vpp1 where Vpp1 is set to 1.42 kV. The results are indicated by classification in which "×" denotes that the defect occurs, "Δ" denotes that the defect occurs only in the low temperature/low humidity environment, and a "O" denotes that no defect occurs.

Also, when the discharge product produced by the electric discharge is adhered to the photoreceptor, normally the pure-water contact angle tends to decrease. Therefore, as the evaluation of the discharge product, a change of the surface of the photoreceptor is evaluated by a difference in pure-water contact angle (contact angle difference).

Figures 9A, 9B:
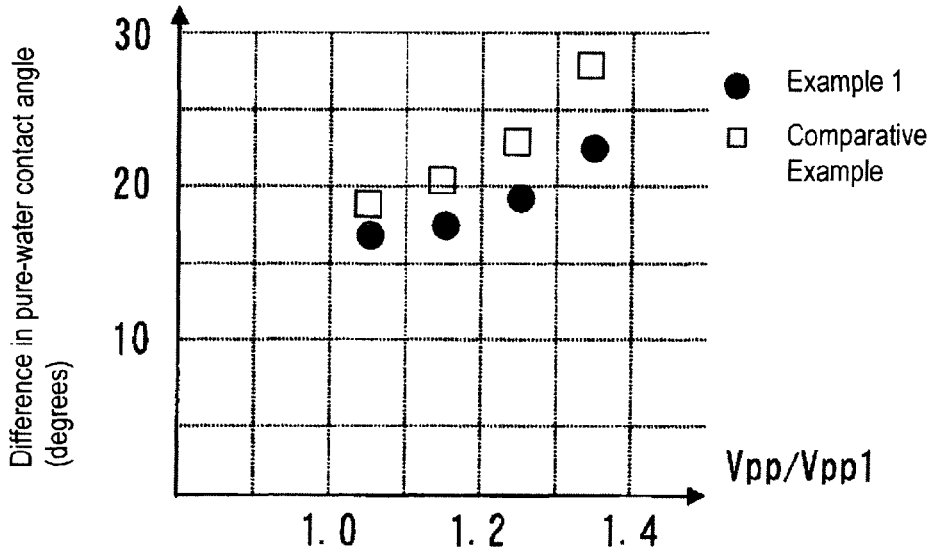

As shown in FIGS. 9A and 9B, it is confirmed that although the discharge region is reduced in comparison with than Comparative Example, nevertheless Example 1 has such a superiority that an amount of the discharge product is smaller than that in Comparative Example while keeping the charging ability comparative to that in Comparative Example.

Such evaluation results will be specifically described in detail below.

In the results of the evaluation of image quality, as shown in FIG. 9A, no clear difference is found between Example 1 and Comparative Example. When Vpp/Vpp1 is 1.05 or 1.15, the defect of the image quality occurs irrespective of the environmental conditions. Also, when Vpp/Vpp1 was 1.25, the defect of the image quality occurs only in the low temperature/low humidity environment. This is because the low temperature/low humidity environment makes it easy to generate the electric discharge. Also, when Vpp/Vpp1 is 1.35, the stable image quality is obtained.

According to these results, although the discharge region in the charge device of Example 1 is reduced to be smaller than that in the configuration in which the electric discharge is caused in both the upstream-side gap portion and the downstream-side gap portion, like the charge device of Comparative Example, it is found that the stable discharge can be caused in the downstream-side gap portion by superposing the sufficiently large AC component Vpp onto the DC component Vdc as the charge bias and thus the charging ability similar to that in Comparative Example can be provided in Example 1.

Also, in the evaluation results of the discharge product (a frequency of the AC component Vpp is set to 1,440 Hz), as shown in FIG. 9B, when the AC component Vpp is increased a difference in pure-water contact angle is increased in both Example 1 and Comparative Example. However, the different in pure-water contact angle in Example 1 is smaller than that in Comparative Example. For example, when Vpp/Vpp1 is set to 1.35, the different in contact angle is about 22° in Example 1, whereas the difference in contact angle is about 28° in Comparative Example.

The reason for this is considered such that, since the electric discharge in the upstream-side gap portion is suppressed in Example 1, and thus the discharge product is produced only by the electric discharge in the downstream-side gap portion, an amount of the discharge product is reduced to be smaller than that in Comparative Example in which the electric discharge is caused in both the upstream-side gap portion and the downstream-side gap portion. Here, when the photoreceptor is rotated by even 30 turns, the influence is confirmed. This is because it is attempted to quickly confirm the usefulness of Example 1 by creating such a situation that the cleaning effect obtained by applying the cleaning device or the like to the photoreceptor is not expected. In the actual device configuration, it is apparent that such usefulness of Example 1 appears as a longer-term change because of the action of the cleaning device, and the like.

Example 2

In Example 2, it is checked how an amount of wear of the photoreceptor is changed by carrying out a specific running test in the configuration in Example 1. At this time, Comparative Example as well as Example 1 is evaluated.

As the test conditions of the charge bias, the DC component Vdc is set to −710 V, a frequency of the AC component Vpp is set to 1,440 Hz, and Vpp/Vpp1 is changed. Also, a process speed is set to 208 mm/sec.

Also, the printing condition is that an image of 5% in image area ratio is used, the number of prints per job is 100, and the printing per job is repeated so that the total number of prints become 30,000. Also, the environmental condition is that 22° C. and 50% RH, and an amount of wear of the photosensitive layer per rotation of the photoreceptor is calculated by measuring appropriately a film thickness of the photosensitive layer of the photoreceptor in.

Figure 10:
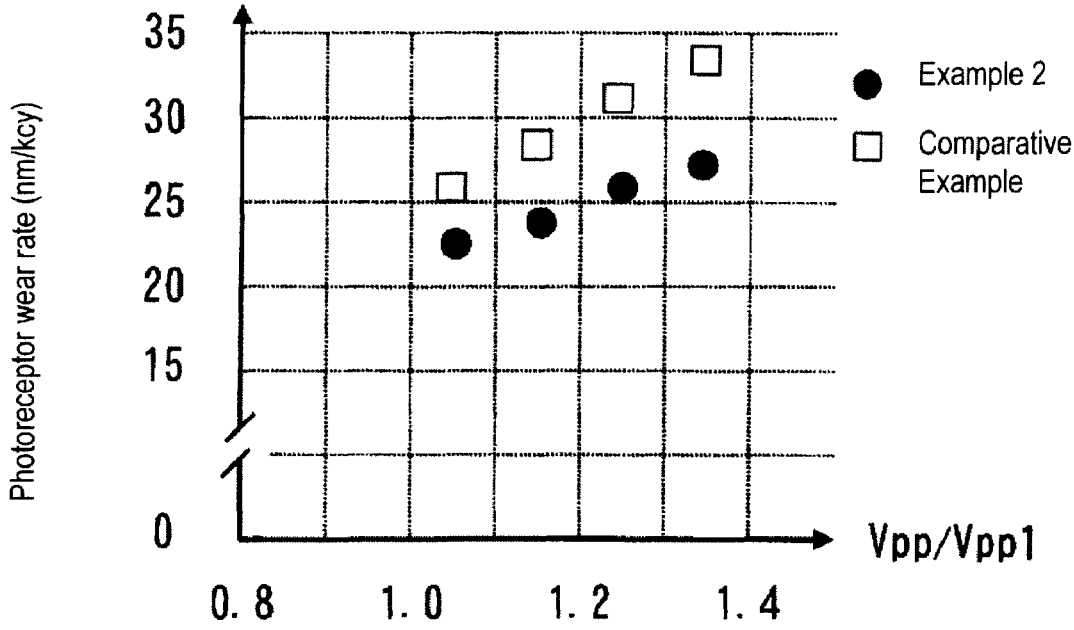
FIG. 10 is a graph showing a result of Example 2.

In the results shown in FIG. 10, it is confirmed that the wear is reduced in Example 2 as compared with Comparative Example. For example, when the ratio Vpp/Vpp1 is set to 1.35, a photoreceptor wear rate is about 34 nm/key in Comparative Example, whereas a photoreceptor wear rate is about 27 nm/key in Example 2. This indicates that Example 2 has the effect of reducing the wear of the photoreceptor by 20% or more rather than Comparative Example. Here, since the total printing number of 30,000 corresponds to about 120 key, the wear of the photosensitive layer of about 3.6 μm occurs in response to the total printing number in Example 2.

Example 3

In Example 3, in order to check the effectiveness of the discharge in the downstream-side gap portion of the exemplary embodiments, the effect caused by irradiating light onto the upstream-side gap portion is checked in the configuration of the exemplary embodiment 1 (see FIG. 3) and the configuration of the exemplary embodiment 2 (see FIG. 7).

If both the upstream-side gap portion and the downstream-side gap portion have a great influence as the charging areas, normally the charged potential (surface potential) of the photoreceptor after the charging becomes smaller when light is irradiated onto the photoreceptor. However, in such a situation that the electric discharge that has an influence on the charging is mainly performed in the downstream-side gap portion, even if light is irradiated onto the upstream-side gap portion to thereby eliminate the charged potential of the charged photoreceptor, the charged potential after charging is almost not influenced.

From such a viewpoint, the light irradiation is checked with the ratio Vpp/Vpp1 of 1.35. In this case, no significant difference appears particularly. It is confirmed that the charge potential is substantially determined by the discharge in the downstream-side gap portion during charging. This means that, even if the electric discharge in the upstream-side gap portion is reduced, there is no significant demerit in terms of performance. From this respect, the usefulness of the exemplary embodiments is further appreciated.

What is claimed is:

1. A charge device comprising:

an endless charging belt configured to come into contact with a moving charged body and to circulate in a same direction as a moving direction of the charged body;

an electrode member that is disposed to be in contact with a part of an inner peripheral surface of the charging belt, the electrode member that is disposed to face the charged body across the charging belt between the electrode member and the charged body;

a bias applying unit that applies a charge bias to the electrode member, the charging belt including a contact portion that is in contact with the charged body, an upstream-side portion that is adjacent to the contact portion on an upstream side thereof in the moving direction of the charged body, and a downstream-side portion that is located adjacent to and downstream of a position where the electrode member faces the charged member in the moving direction of the charged body; and a discharge region forming member that brings the contact portion of the charging belt into contact with the charged body without contact with the electrode member and causes the upstream-side portion of the charging belt not in contact with the charged body to form a discharge suppression region in which discharge is suppressed between the upstream-side portion and the charged body, wherein the discharge region forming member brings the downstream-side portion into contact with the electrode member without contact with the charged body to form a discharge region in which discharge occurs between the downstream-side portion of the charging belt and the charged body.

2. The charge device according to claim 1, wherein the discharge region forming member includes a guide member that comes into contact with an outer peripheral surface of the charging belt to guide the charging belt in a predetermined direction.

3. The charge device according to claim 2, wherein the guide member is opposite to the electrode member across the charging belt.

4. The charge device according to claim 3, wherein the discharge region forming member further includes a pressing member that is provided in a position where the charging belt is in contact with the electrode member and on an upstream side of a position of the guide member in the moving direction of the charging belt, the pressing member that presses the charging belt against the electrode member so that the charging belt is circulatable.

5. The charge device according to claim 4, wherein the electrode member includes a rotary roller, and the guide member is rotated at a peripheral velocity that is larger than a peripheral velocity of the electrode member.

6. The charge device according to claim 3, wherein the electrode member includes a rotary roller, and the guide member is rotated at a peripheral velocity that is larger than a peripheral velocity of the electrode member.

7. The charge device according to claim 2, wherein the discharge region forming member further includes a pressing member that is provided in a position where the charging belt is in contact with the electrode member and on an upstream side of a position of the guide member in the moving direction of the charging belt, the pressing member that presses the charging belt against the electrode member so that the charging belt is circulatable.

8. The charge device according to claim 7, wherein the electrode member includes a rotary roller, and the guide member is rotated at a peripheral velocity that is larger than a peripheral velocity of the electrode member.

9. The charge device according to claim 2, wherein the electrode member includes a rotary roller, and the guide member is rotated at a peripheral velocity that is larger than a peripheral velocity of the electrode member.

10. The charge device according to claim 1, wherein the discharge region forming member is provided on the upstream side of the electrode in the moving direction of the charged body, and the discharge region forming member is in contact with an inner peripheral surface of the charging belt to stretch the charging belt.

11. The charge device according to claim 10, wherein the discharge region forming member is opposite to the charged body across the charging belt.

12. The charge device according to claim 1, wherein the bias applying unit applies to the electrode member the charge bias in which an AC component is superimposed on a DC component, and the AC component exceeds a changing point in gradients of charge potentials of the charged body with respect to AC components and is in a predetermined range.

13. An image formation assembly comprising:

the charge device according to claim 1; and the charged body including a photoreceptor, wherein the charge device is provided to be opposed to the charged body, the image formation assembly is detachably attached to a main body of an image formation apparatus.

14. An image formation apparatus comprising:

the charge device according to claim 1; and the charged body including a photoreceptor, wherein the charge device is provided to be opposed to the charged body.

15. An image formation apparatus comprising:

a charge device; and a charged body including a photoreceptor, wherein the charge device is provided to face the charged body, the charge device includes an endless charging belt configured to come into contact with a moving charged body and to circulate in a same direction as a moving direction of the charged body, an electrode member that is disposed to be in contact with a part of an inner peripheral surface of the charging belt, the electrode member that is disposed to face the charged body across the charging belt being sandwiched between the electrode member and the charged body, and a bias applying unit that applies a charge bias to the electrode member, the charging belt includes a downstream-side portion that is adjacent to and downstream of a facing position where the charged body faces the electrode member, in the moving direction of the charged body, a contact portion that is in contact with the charged body without the contact portion being in contact with the electrode member, the contact portion that is adjacent to the facing position on an upstream side of the facing position in the moving direction of the charged body, and an upstream-side portion that is adjacent to the contact portion of the charging belt on an upstream side of the contact portion in the moving direction of the charged body, the upstream-side portion that is in contact with none of the electrode member and the charged body, and, a discharge region in which discharge can occur is formed between the downstream-side portion of the charging belt and the charged body, and a discharge suppression region in which discharge is suppressed is formed between the upstream-side portion of the charging belt and the charged body.

* * * * *